US005338166A

United States Patent [19]

Schultz

[11] Patent Number: 5,338,166

[45] Date of Patent: Aug. 16, 1994

[54] EVACUATION PUMP SYSTEM FOR BOTH RIGID AND FLEXIBLE CONTAINERS

[75] Inventor: Glen R. Schultz, Yorkville, Ill.

[73] Assignee: Pioneering Concepts Incorporated, Yorkville, Ill.

[21] Appl. No.: 18,201

[22] Filed: Feb. 16, 1993

[51] Int. Cl.[5] ..... F04B 39/10; B65B 31/04

[52] U.S. Cl. ..... 417/442; 417/503; 417/553; 137/625.41; 53/510; 53/512; 53/88

[58] Field of Search ..... 417/442, 456, 458, 503, 417/545, 553, 238; 137/625.41, 625.24, 625.47; 53/510, 512, 88, 103

[56] References Cited

U.S. PATENT DOCUMENTS

| | | | |
|---|---|---|---|
| 1,157,907 | 10/1915 | Sperry | 137/625.47 |
| 1,491,115 | 4/1924 | Taylor | 137/625.47 |
| 3,139,907 | 7/1964 | Jones | 137/625.47 |
| 3,364,947 | 1/1968 | Bragt | 137/625.47 |
| 4,583,925 | 4/1986 | Hawkins | 417/555 R |
| 4,745,730 | 5/1988 | Bartle, Sr. | 53/512 |
| 4,886,212 | 12/1989 | Proctor et al. | 137/625.47 |
| 4,975,028 | 12/1990 | Schultz | 417/442 |
| 5,121,590 | 6/1992 | Scanlan | 53/103 |
| 5,148,839 | 9/1992 | Kirwan et al. | 137/625.24 |

FOREIGN PATENT DOCUMENTS

| | | | |
|---|---|---|---|
| 611846 | 6/1979 | Czechoslovakia | 53/103 |
| 166478 | 8/1950 | Fed. Rep. of Germany | 53/103 |
| 620292 | 4/1927 | France | 53/103 |
| 307939 | 9/1932 | Italy | 53/103 |

*Primary Examiner*—Louis J. Casaregola
*Assistant Examiner*—Roland G. McAndrews, Jr.

[57] ABSTRACT

An improved evacuation pump system uniquely designed to evacuate both lidded rigid containers and sealable flexible containers. A vacuum cup fixed to one end of a reciprocating piston pump attaches to the lid of rigid containers for their evacuation and a flexible probe connects to the pump for flexible container evacuation. To achieve this dual function a inlet passage in the pump has a cross bore that slidably and/or rotatably receives a two position valve that selectively connects the pumping chamber with two outlets, one associated with each mode. The flexible probe connects directly to this valve reducing the need for separate passageways.

10 Claims, 5 Drawing Sheets

EVACUATION PUMP SYSTEM FOR BOTH RIGID AND FLEXIBLE CONTAINERS

BACKGROUND OF THE INVENTION

This invention relates to a pump apparatus for evacuating containers. The invention is particularly adapted to evacuate air from food storage containers, such as jars and plastic bags.

The prior art is prolific in patents that disclose various types of pumps for evacuating air from food containers. The most pertinent patents to the present invention are believed to be the following:

Gill, U.S. Pat. No. 29,582
Winters, U.S. Pat. No. 638,383
Desmond, U.S. Pat. No. 882,874
Staunton, U.S. Pat. No. 1,601,705
Herzog, et al., U.S. Pat. No. 2,401,638
Crook, U.S. Pat. No. 2,648,474
Haley, U.S. Pat. No. 2,695,741
Reisinger, U.S. Pat. No. 3,312,256
Katell, U.S. Pat. No. 3,313,444
Ruberg, U.S. Pat. No. 4,278,114
Maruscak, U.S. Pat. No. 4,337,804
Scanlan, U.S. Pat. No. 4,478,025
von Bismarck, U.S. Pat. No. 4,575,990
Hawkins, U.S. Pat. No. 4,583,925
Bartle, St., U.S. Pat. No. 4,745,730
European Patent No. 0 117 247
German Patent No. 33 35 001
Swiss Patent No. 200,360

These patents disclose pumps for evacuating either rigid containers (jars) or deformable containers (plastic bags), but not both. Additionally, the arrangements most pertinent to this invention employ complex and difficult to apply check valves to the covers (or lids) of rigid containers to be evacuated.

The present invention is an improvement on my U.S. Pat. No. 4,975,028 and portions of the specification thereof have been included in this application.

The pump apparatus in my prior patent consists of three principal components; in particular, (1) a specially designed disposable/reusable, pressure-sensitive, adhesive-tape check valve that adheres to a container lid and covers a small air evacuating hole, (2) a reciprocating two-stroke piston pump that features an efficient piston check-valve and a vacuum cup which cooperate with plugable porting to provide for evacuation of both rigid and deformable containers, and (3) an accessory probe which is plugged into a side plugable port of the pump to evacuate deformable containers such as plastic bags, while the bottom plugable port is plugged.

With this pump apparatus, a jar can be reused thousands of times to store anything that will fit and which will keep better in a vacuum. The apparatus also pulls a vacuum on an ordinary plastic zipper-lock type bag and allows the zipper to be closed without losing the vacuum. The apparatus will also evacuate many leak proof bags that might be sealed with a commercial home-style hot-sealing machine.

While my prior patented design works well and has achieved considerable commercial success, I have devised an improved pumping system that eliminates the need for a check valve in the flexible probe assembly and the requirement for a removable plug to maintain cup suction. The prior in-line check valve has many parts and is difficult to manufacture and expensive to purchase preassembled. The removable plug works well in maintaining suction in the cup but it is easily lost and its use requires careful operator instruction.

Therefore, it would be desirable, and it is the principal object of the present invention to not only eliminate the need for the in-line check valve in the flexible probe assembly and the removable plug for vacuum cup, but also to provide an evacuation apparatus that is simpler to use and requires less operator instruction.

A principal object of this invention is to provide relatively simple, inexpensive and effective apparatus for evacuating both rigid and deformable containers, such as jars with lids and also plastic bags.

SUMMARY OF THE PRESENT INVENTION

In accordance with the present invention an improved evacuation pump system is provided that is uniquely designed to evacuate both lidded rigid containers and sealable flexible containers with a quick change valve shiftable from one mode to the other without removing or replacing parts.

Toward these ends an elastomeric vacuum cup, that also forms one of the end caps for the pump assembly, releasably attaches to the lid of a rigid container in the rigid container evacuation mode. This elastomeric cup and end cap, has a cross bore therein that receives a shiftable valve member having an outlet port at one end that releasably connects in one position thereof to a flexible probe utilized in the flexible bag evacuation mode. The valve member is shiftable to a second position where it communicates the interior of the vacuum cup in the rigid container evacuation mode to the pumping chamber and seals the outlet port for the flexible container evacuation probe.

These improvements eliminate the need for the plugs associated with the pumping apparatus described in connection with my U.S. Pat. No. 4,975,028, which not only are easily lost but make the pumping apparatus significantly more difficult to operate, particularly without instructions.

Other objects and advantages of the present invention will appear more clearly from the following detailed description.

BRIEF DESCRIPTION OF THE DRAWINGS

In order that all of the structural features for attaining the objects of this invention may be understood, reference is made to the accompanying drawings wherein.

DETAILED DESCRIPTION OF THE PREFERRED EMBODIMENT

Figure 4:
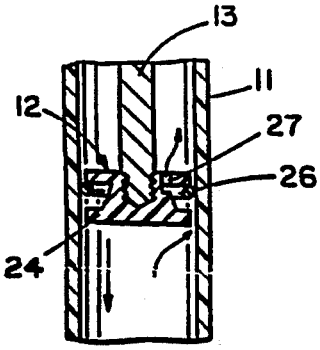
FIG. 4 PRIOR ART
FIG. 4 is a fragmentary section view of the pump piston-valve during a piston down-stroke.
Figure 5:
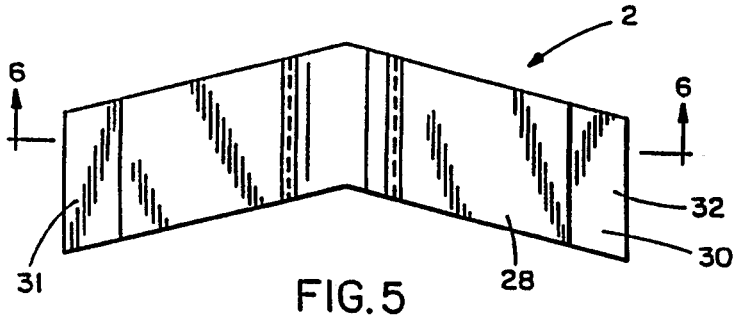
FIG. 5 PRIOR ART
FIG. 5 is a plan view of the adhesive-tape check valve with its peel-off, throw-away backing attached to protect the adhesive layer and the elastomer pad of the valve.
Figure 6:
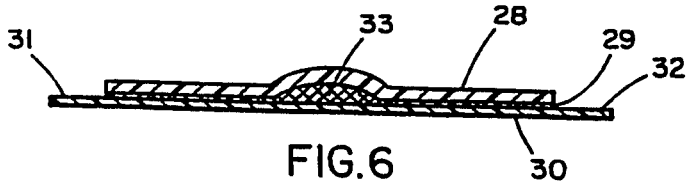
FIG. 6 PRIOR ART
FIG. 6 is a section view taken along line 6—6 of FIG. 5 which shows the several layers of the adhesive-tape check valve and the encapsulated elastomer pad.

Referring to the drawings, the principal components of my patented design (FIGS. 1 to 9) comprise piston pump 1 and an adhesive tape check valve 2 (FIGS. 5 and 6). This is particularly adapted to evacuate rigid containers, such as jar 3, by applying check valve 2 over a small hole punched in lid 4 of jar 3.

Pump 1 in association with probe 5 (FIG. 7) is also used to evacuate a non-rigid container, such as plastic bag 6. An in-line check valve 7 (FIGS. 7 and 8) having a rigid housing is inserted in the air line of probe 5.

In the first use, plug 8 is inserted in side port 9 (FIG. 1) to block a side inlet; however, in the second plug use plug 8 is removed from the side port 9, and check valve 7 end of probe 5 is inserted in side port 9. Plug 8 is inserted in the throat of vacuum cup 10 (FIG. 9) to block any possible passage of air through the vacuum cup and to convert the vacuum cup into a vacuum cup so that the pump assembly can be affixed to a table.

Piston pump 1 is used in both modes without any change in structure. In particular, the pump consists of a $1\frac{3}{4}$ inch diameter vacuum cup 10 fabricated from a flexible soft plastic and is fixed to one end of plastic tube 11. Tube 11 defines a pump cylinder, the bore of which houses a uniquely designed 0-ring piston-check-valve 12. The piston-check-valve is connected to one end of a spring-loaded, metal or plastic rod 13; and a manually actuatable push-pull knob 14 is fixed to the other rod end to reciprocate the piston-check-valve to effect air evacuation. Rod 13 need not be spring loaded when evacuating a jar.

Pump 1 is approximately 14 inches long when assembled for use. Tube 11 is approximately 6 inches long and it has a $\frac{7}{8}$ inch outside diameter. For shipment, cleaning and storage, the pump may be broken down to about 9 inches with one simple jerking motion which separates top end cap 15 from cylinder 11. Alternately, the pump assembly may be conveniently stored in a broom clip on a wall or cabinet door.

Figure 1:
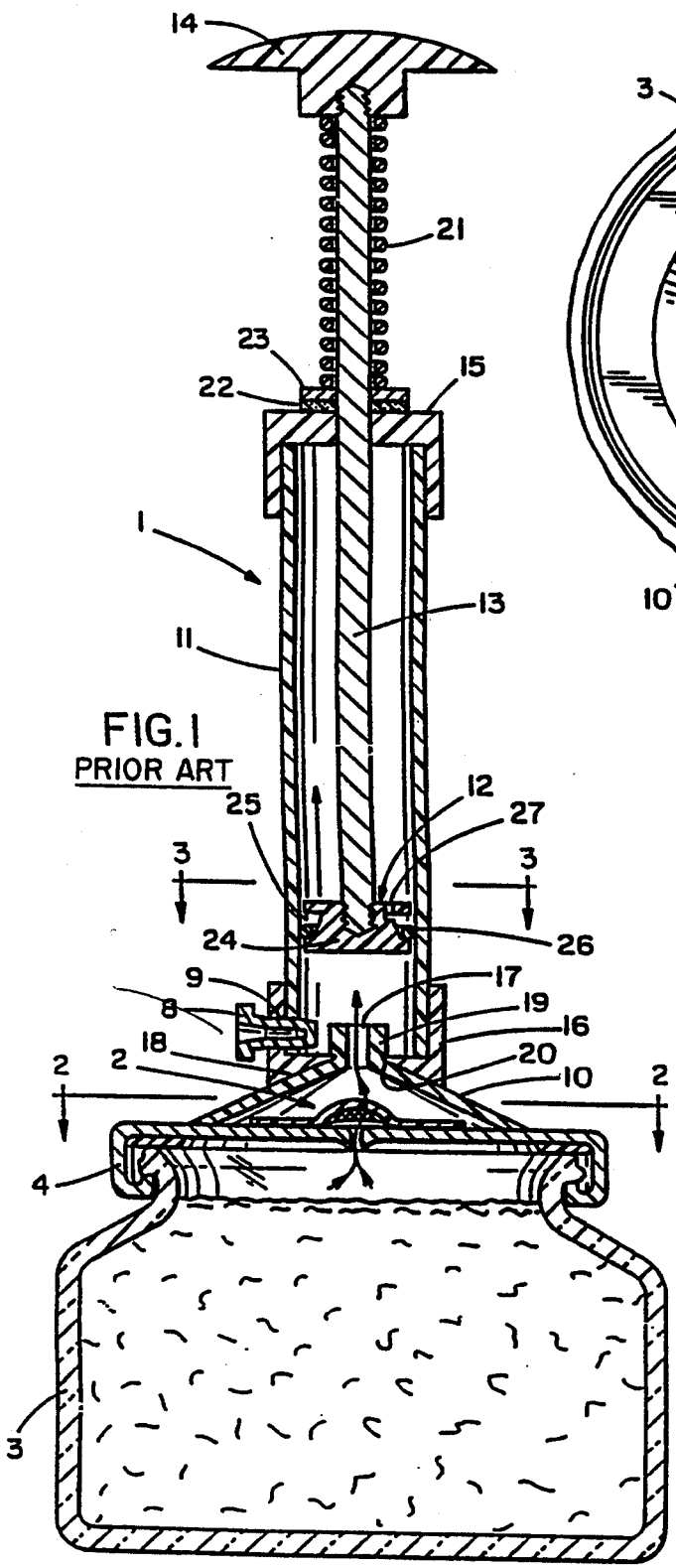
FIG. 1 PRIOR ART
FIG. 1 is an elevation view in section of the pump apparatus shown in my prior patent during a piston up-stroke applied to the lid of a container (food jar) to evacuate air from the inner container cavity which holds the material (food) to be preserved.
Figure 2:
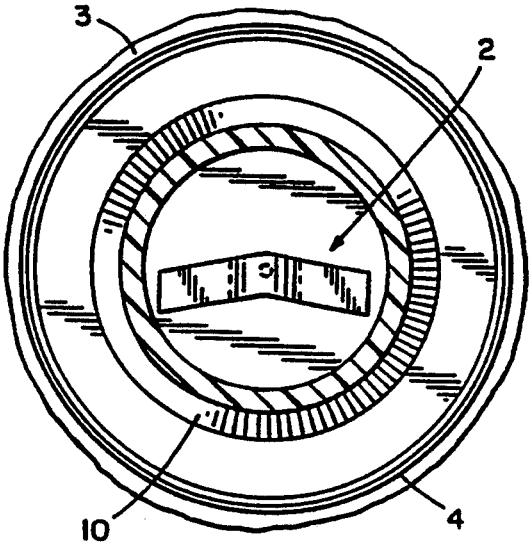
FIG. 2 PRIOR ART
FIG. 2 is a section view taken along line 2—2 of FIG. 1 which shows a plan view of a specially designed disposable/reusable, pressure-sensitive, adhesive-tape check valve applied to the container of FIG. 1.
Figure 3:
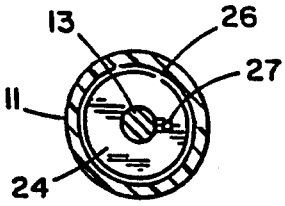
FIG. 3 PRIOR ART
FIG. 3 is a section view taken along line 3—3 of FIG. 1 which shows the vent hole for the pump piston-valve.

Bottom end cap 16 couples vacuum cup 10 to the lower end of tube 11. Side port 9 extends through both tube 11 and bottom end cap 16. Plug 8 is inserted in port 9 when air is to be evacuated from jar 3 through the central passage formed by throat 17 of vacuum cup 10, as is shown in FIG. 1. Tube 11 and end caps 15 and 16 are formed of rigid shatter resistant such as CPVC plastic. The tube and end caps could also be fabricated of glass or metal.

An inwardly projecting annular lip 18, which defines a centrally located hole, is integrally formed on the lower portion of bottom end cap 16. Neck 19 of vacuum cup 10 is formed with an annular recess 20 which engages lip 18 when neck 19 is press fit through the hole formed by lip 18. The special shape of the bottom end cap defines a small chamber into which adhesive-tape check valve 2 can move up and down. Without this chamber vacuum cup 10 would be sucked flat by the pumping action, thereby ultimately defeating the operation of adhesive-tape check valve 2.

Top end cap 15 is formed with a central hole to enable spring-loaded rod 13 to reciprocate within the cylinder cavity defined by tube 11. Knob 14 is threaded, glued or snap fitted onto the upper end of the rod. Helical return spring 21 envelopes rod 13 between knob 14 and top end cap 15. The return spring is sized for easy operation and to supply sufficient force to provide adequate vacuum with a reasonable number of strokes, and to withstand many operations.

Optionally, spring 21 and rod 13 are continuously lubricated by an oil saturated felt washer 22 sandwiched between a flat steel washer 23 and top end cap 15. Return spring 21 keeps washer 22 in permanent compression so as to fit tightly around rod 13.

Body 24 of piston-check-valve 12 is fabricated from a machined or molded plastic, metal, or ceramic. The outer periphery of piston body 24 is formed with an annular groove 25. This groove width is oversized relative to the cross-section of its contained O-ring 26, and the groove diameter is tapered and small at one end relative to the inside diameter of its contained O-ring, in order to provide proper pumping action which requires movement of the O-ring within the groove. A small piston vent hole 27 (FIG. 3) or notch provides an air passage from groove 25 through the upper portion of body 24.

Body 24 is sized diameter-wise so as to have a loose fit relative to the inner cylinder wall of tube 11. Air flows between body 24 and tube 11 unless this passage is blocked by O-ring 26.

Piston-check-valve 12 is open during the downstroke (FIG. 4). In particular, during the piston down-stroke, O-ring 26 is forced upwardly against the top of oversized groove 25 by friction engagement with the cylinder wall. Accordingly, air flows around the periphery of the lower portion of piston body 24 into groove 25 below O-ring 26, and ultimately through piston vent hole 27 into the upper cylinder cavity.

Piston-check-valve 12 is closed during the up-stroke (FIG. 1). In particular, during the piston up-stroke, O-ring 26 is forced downwardly against the bottom of oversized groove 25 by friction engagement with the cylinder wall. This action closes off the air passage otherwise appearing between the loose fitting piston body 24 and the adjacent cylinder wall. During the piston up-stroke, air confined in the cylinder cavity located above body 24 is forced out of pump 1 by a venting passage formed between rod 13 and top end cap 15.

During the piston up-stroke, adhesive-tape check valve 2 is open, as is shown in FIG. 1, thereby evacuating jar 3 of air. Conversely, during the piston down stroke, check valve 2 is closed.

Adhesive-tape check valve 2 (FIGS. 5 and 6) may be rectangular or chevron shaped or various other shapes in the preferred embodiment shown in the drawings. Either configuration facilitates reciprocating action which is necessary for a reliable check-valve action. The point of the chevron shaped valve may be preferred by some for easy removal of the valve or release of the vacuum.

Adhesive-tape check valve 2 is formed with a tape layer 28 which is coated with an adhesive layer 29. The adhesive-tape is supported on a throw-away, peel-off backing 30 whose ends 31 and 32 extend beyond layers 28 and 29.

An elastomer pad 33 which serves as a valve seat is captured in the central portion of tape layer 28 between adhesive layer 29 and backing 30. A preferred sealing material is a low durometer (about 30, Shore A) FDA elastomer pad of approximately $0.31 \times 0.31 \times 0.020$ inch which is bonded to the adhesive layer of the tape. The tape and sealing material that make up valve 2 can be reused many times.

The actual construction of valve 2 is accomplished by running a roll of vinyl adhesive-tape partially around a roller having a groove. The non-sticky side is in contact with the roller. The tape is manipulated so it conforms to the groove in the roller. Another roller in close proximity to the first has a roll of backing material partially wrapped around it. The backing is about 15 inches wide and the vinyl tape is 1.0 inches wide. The two tapes are roll pressed together. The void created by the groove in the first roller is filled with an FDA (food grade) uncured silicone rubber that is injected into the void just at the pinch line of the two rolls. After the silicone rubber cures, the valve are die-cut through the vinyl tape and silicone rubber but not through the backing. The valves are then distributed in lengths containing 25 to 50 valves per length.

In preparation for evacuating resealable jar 3, a small hole is punched in lid 4 near the center of the lid. Check valve 2 is placed (with peel-off backing 30 removed) with elastomer sealing pad 33 covering the small hole. During operation, vacuum cup 10 is placed on lid 4 over valve 2 (FIG. 1). As knob 14, rod 13, and piston-check-valve 12 are pushed down, piston-check-valve 12 is opened and adhesive-tape check valve 2 is closed. As spring 21 returns piston-check-valve 12 and rod 13 to its extended position, piston-check-valve 12 is closed and adhesive-tape check valve 2 is opened and air is drawn from jar 3 by the vacuum created by piston pump 1. The knob may also be pulled up manually if the spring is not used. The spring tension and piston diameter are designed to cause a vacuum, in the range of 25 to 27 inches of mercury, to be attainable.

Repeated reciprocations are made until jar 3 is adequately evacuated, which is noted by only a partial return of the knob 14 and rod 13 assembly to its fully extended position, or by the feel of a tightly adhered vacuum cup to the jar lid. This feeling of tightness can be compared when pump 1 is sucked tight to that of a smooth flat surface with no hole or other leaks. The number of reciprocations required for adequate evacuation varies with the volume of air in the jar. Maximum vacuum may be reached with as few as two reciprocations.

After jar 3 has been adequately evacuated, pump 1 is removed with adhesive-tape check-valve 2 remaining in place. When one desires to open jar 3, all that is necessary to release the vacuum, is simply to lift the sealing pad portion of valve 2 only far enough to uncover a portion of the hole in lid 4. After the hissing noise stops, the vacuum has been released and the jar may be more easily opened.

Contrary to the belief of some, nearly all of the vacuum sealed "throw-away" jars on the market today may be permanently resealed. Furthermore, by using pump 1 of this invention, the same jar, lid, and adhesive-tape check-valve 2 may be resealed many times. And, since adhesive-tape check-valve 2 is itself reusable, it may be transferred to another jar lid.

Additionally, using pump 1 of this invention, allows any store bought sealed jar to be easily opened, even by people with small and/or arthritic hands. Punching the hole in the jar lid, releases the vacuum that initially caused the jar to open with difficulty. After releasing the vacuum the hole may be covered with the adhesive-tape check valve in preparation for sealing.

Figure 8:
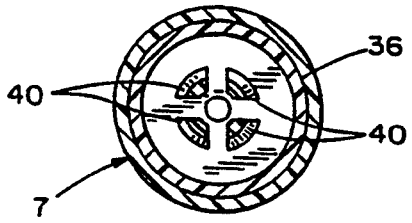
FIG. 8 PRIOR ART
FIG. 8 is a section view taken along line 8—8 of FIG. 7 which shows the internal construction of the check valve used in the probe of FIG. 7.
Figure 7:
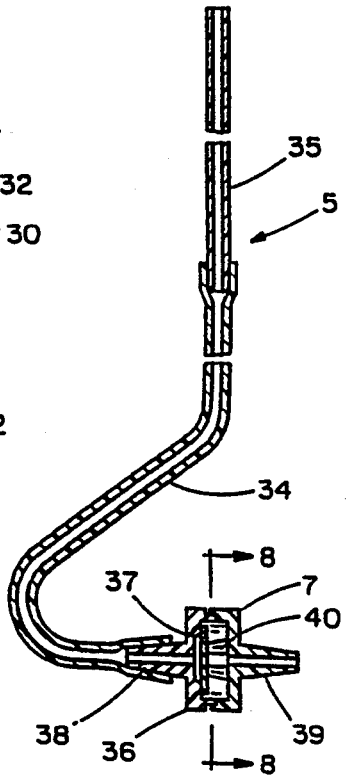
FIG. 7 PRIOR ART
FIG. 7 is an elevation view in section of an optional probe specially designed to evacuate plastic bags.
Figure 9:
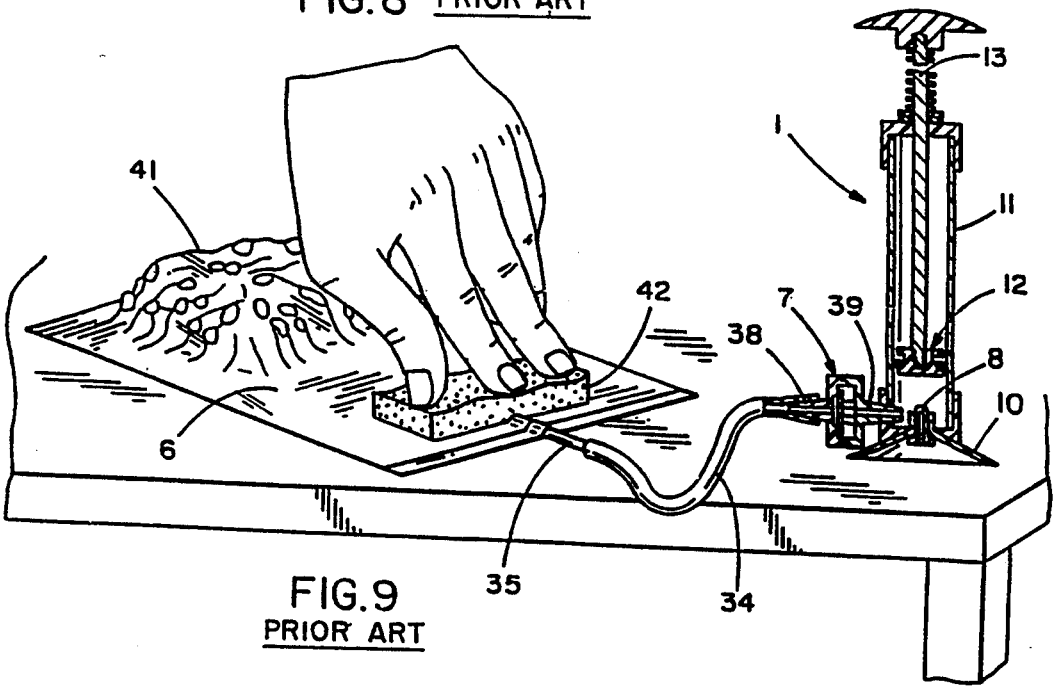
FIG. 9 PRIOR ART
FIG. 9 is a view in-part perspective and in-part in section showing the application of the pump with the probe of FIGS. 7 and 8 to a plastic bag containing material to be preserved.

The second mode shown in FIGS. 7, 8 and 9 employs an accessory kit which forms probe 5. Probe 5 is employed to evacuate non-rigid containers, such as plastic bags (FIG. 9). Probe 5 (FIG. 7) comprises a central section of an FDA approved flexible plastic tubing 34, a straight length of FDA approved rigid plastic tubing 35 inserted into the first end of tubing 34, and an in-line check valve 7 inserted into the other end of plastic tubing 34.

In-line check valve 7 is formed with a plastic housing body 36 that defines an internal cavity that contains a flexible valve seat disc 37 formed from FDA approved material. The periphery of the disc flexes to open and close the valve. Access to this internal cavity is obtained through apertured inlet nipple 38 and through apertured outlet nipple 39. Stop 40 limits the movement of valve seat disc 37 within housing body 36.

When probe 5 is used, the free end of rigid tubing 35 is inserted into the open end of sack 6 (FIG. 9). A foam block 42 is preferably manually employed to hold tubing 35 in place and to keep the sack sealed around tube 35 during evacuation.

Plug 8 is removed from side port 9 (the position shown in FIG. 1), and reinserted into central throat 17 of vacuum cup 10 (the position shown in FIG. 9). Outlet nipple 39 is inserted into port 9, and manual pumping is started as described with respect to the first embodiment of FIG. 1. The periphery of valve seat disc 37 flexes within the cavity of housing body 36. During the down-stroke, disc 37 closes inlet nipple 38; and during the up-stroke, disc 37 flexes against stop 40 thereby opening the check valve to permit air evacuation as previously described with respect to jar 3. When bag 6 has been adequately evacuated, probe 5 is removed from the bag, and the bag clamped closed by conventional means. The seal of the bag may be enhanced by coating the inner walls at the sealing area with vegetable oil, butter, or margarine.

The above description of the pump shown in FIGS. 1 to 9 is substantially the same as described in my U.S. Pat. No. 4,975,028 and has been included herein because the two embodiments illustrated in FIGS. 10 to 17 functionally operate in the same two mode manner to evacuate alternatively either flexible containers or lidded rigid containers so that the general operation of following embodiments will not be described in detail but instead the description will concentrate on the structural improvements in the following embodiments.

The improvements in the two embodiments described with reference to FIGS. 10 to 17 reside primarily in the provision of a movable valve member that makes possible the instantaneous switching from the flexible bag evacuation mode to the rigid container mode by the simple shifting of a valve member carried by the pump itself. This valve member eliminates the need for plugging elements required in my prior patented design and also improves the performance of the pumping assembly.

Figure 10:
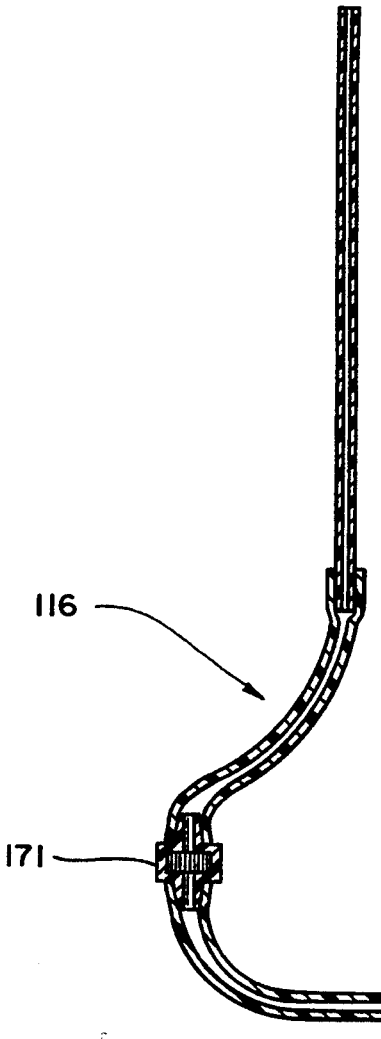
FIGS. 10 and 11 are longitudinal sections of the present pump system in its flexible bag evacuation mode.
Figure 11:
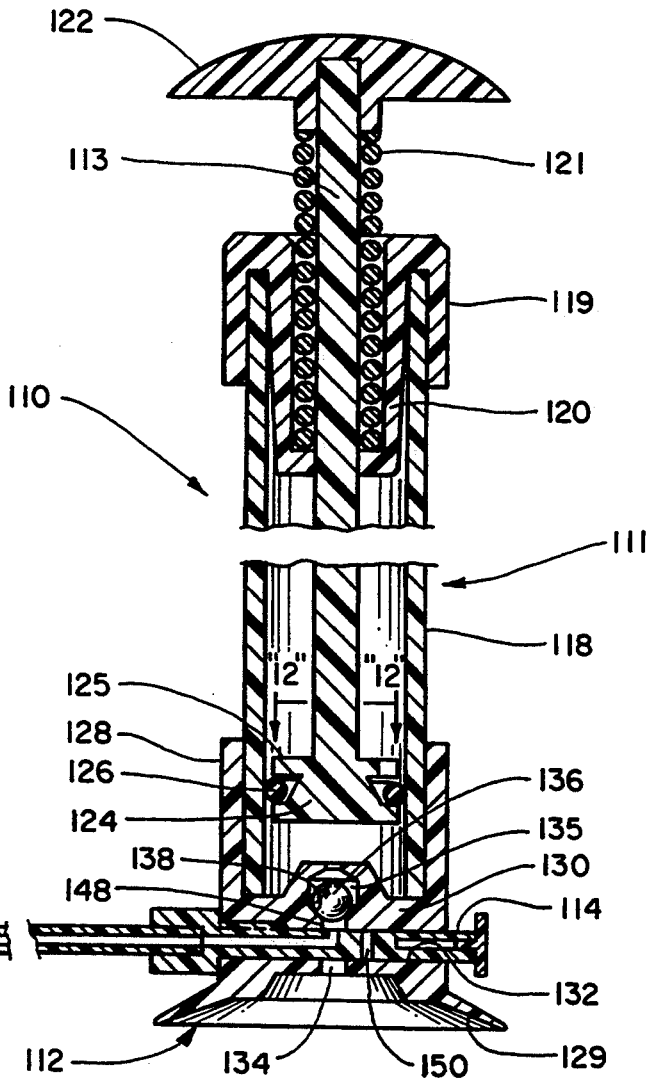
Figure 12:
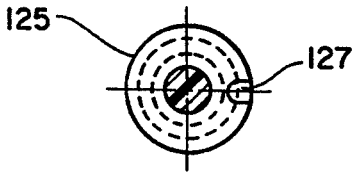
FIG. 12 is a cross-section showing the top of the evacuation piston taken generally along line 12—12 of FIG. 11.
Figure 13:
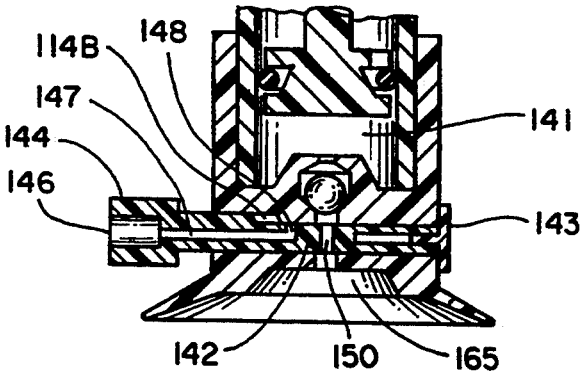
FIG. 13 is a fragmentary section similar to FIG. 11 with the valve member in its rigid container evacuation mode.

The first embodiment is illustrated in FIGS. 10 to 13 with FIGS. 10 and 11 depicting the pumping system in its flexible container evacuation mode and FIG. 13 depicting the pump, and particularly its switching valve, in the rigid container evacuation mode.

As seen in FIGS. 10 to 13 a pumping assembly 110 is illustrated consisting generally of a reciprocating piston pump 111 having a one piece vacuum cup and end cap 112 at its lower end and a one piece piston and rod member 113 projecting from its other end, a push-pull type mode valve 114 reciprocally mounted in the vacuum cup end cap 112, and a flexible bag evacuation probe assembly 116.

The pump assembly 110 includes a one piece cylinder 118 having an upper end cap 119 with a central annular boss 120 extending within cylinder 118 and forming a spring seat for coil compression spring 121. This arrangement reduces the over-all length of the unit because the spring 121 is in part located internally of cylinder 118.

The one piece piston and rod 113 carries a spheroidal knob manual actuator 122 at its upper end and a integral piston 124 at its lower end with a recess 125 receiving an "o" ring 126 that together with aperture 127 as seen in FIG. 12 form a check valve assembly that operates in an identical manner to the piston check valve 12 described in connection with FIGS. 1 and 4 in the FIGS. 1 to 9 embodiment described above.

The vacuum cup end cap 112 is constructed of a elastomeric material having a Shore A durometer in the range of 30 to 50 and includes an upper annular portion 128 that forms the lower end cap for the cylinder 118, a lower vacuum cup portion 129 adapted to be releasably attached on the lid of a rigid container, and a solid central portion 130 that has a cross bore 132 centrally there-through that receives push-pull valve 114 constructed of a rigid plastic material. The central portion 130 has a central axial bore 134 there-through with a circular cross-section that has an enlarged portion 135 forming a cage for a ball check valve 136. The enlarged portion 135 has a valve seat 138 that when engaged by the ball 136 prevents the flow of air from pumping chamber 141 into the evacuation probe 116 so that when the handle 122 is pushed downwardly in its air discharge stroke, air will not be forced through the evacuation probe 116 into the flexible container. The check valve formed by ball 136 and seat 138 replaces and obviates the need for the in-line check valve 7 described in connection with FIG. 7 above, thereby significantly reducing the number of parts required in the total system.

The push-pull valve 114 has a cylindrical central portion 142, an integral enlarged stop 143 at one end, and an annular enlarged fitting 144 at the opposite end having an outlet port 146 formed therein adapted to receive flexible tube portion 148 in the evacuating probe assembly 116.

The port 146 communicates through a central axial passage 147 and radial passage 148 (FIG. 13) with the periphery of the central valve portion 142 and is located so that when the valve 114 is shifted to its right position illustrated in FIG. 11, it will communicate with axial passage 134 in end cap and vacuum cup 112. This position of course defines the flexible bag evacuation mode.

As seen in FIG. 13, the central valve member portion 142 has a second diametral passage 150 extending completely there-through coplanar with valve passage 148 that communicates with the axial passage 134 when the valve 114 is shifted to its left position illustrated in FIG. 13 which defines the rigid container evacuation mode.

In the flexible container evacuation mode illustrated in FIG. 11, passage 150 is sealed by the soft elastomeric material of bore 132 and similarly in the rigid container evacuation mode the radial passage 148 is sealed by bore 132.

Thus it can be seen that the simply constructed one piece valve member 114 defines not only the outlet port for the probe assembly 116 but also in conjunction with the cap and cup 112 selectively communicates one of the passages 148 or 150 with main pump inlet passage 134, and alternately blocks the other passage to achieve the dual mode function of the present pumping assembly 110.

A key 114*a* attached to sliding valve member 114 slides in a key way 114*b* to prevent inadvertent rotation of valve body 114 which would prevent proper communication of ports 150, 148 and 134.

Figure 15:
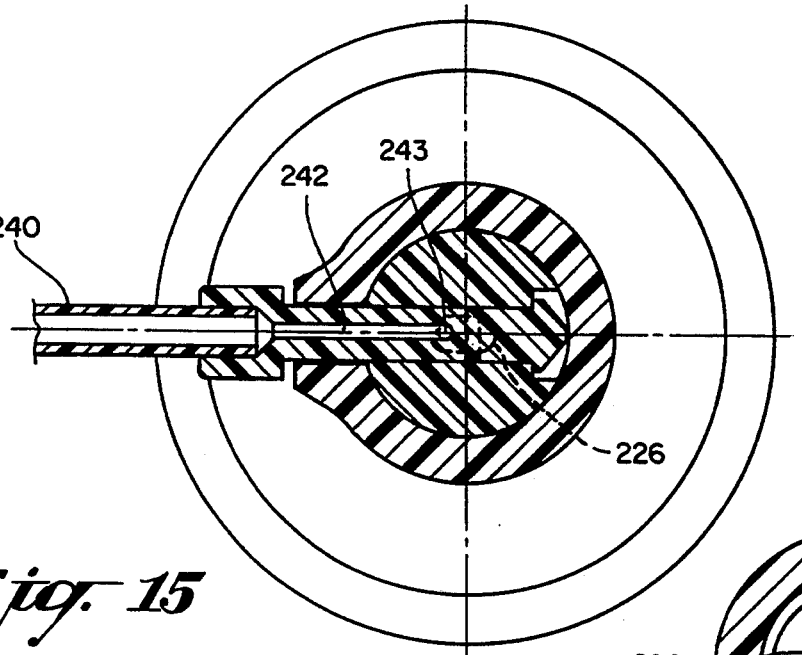
FIG. 15 is a cross section showing the valve member taken generally along line 15—15 of FIG. 14.
Figure 16:
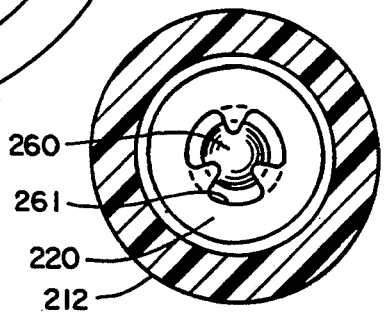
FIG. 16 is a cross section taken generally along line 16—16 of FIG. 14.
Figure 14:
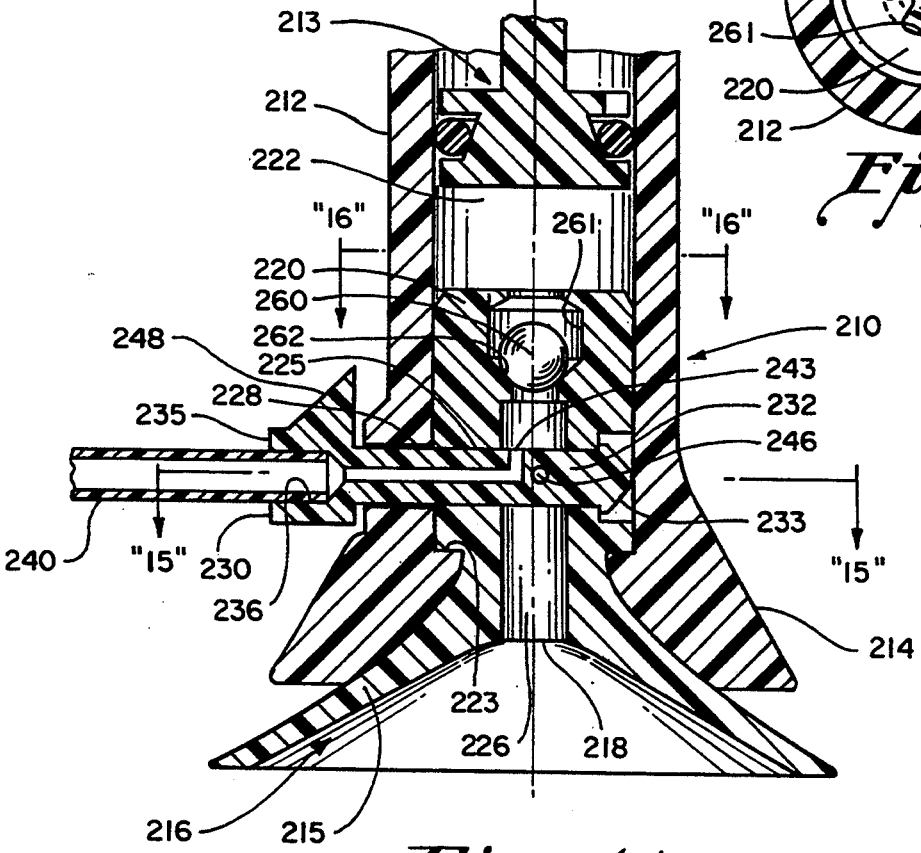
FIG. 14 is a fragmentary longitudinal section of still another embodiment of the present pump system.

Still another embodiment of the present pumping system is illustrated in FIGS. 14 to 17 and it is exemplified as pumping assembly 210. The pump 210 is illustrated in FIG. 14 and 15 in the flexible bag evacuation mode and in FIG. 17 in the rigid container evacuation mode. As seen in these views the pump cylinder 212 has piston and rod assembly 213 reciprocably mounted therein identical with piston and rod 113 shown in FIG. 11. In this embodiment however the lower end of the cylinder 112 is outwardly flared at 214 defining a frustoconical surface 215 that receives a complimentary plug portion 220 of vacuum cup member 216. The cup portion of the vacuum cup has an upper central area 218 that is held open by the flared portion 214 of cylinder 212 during the rigid container suction mode to prevent the cup portion from collapsing on the check valve attached to the container lid. This is the same function performed by recess 165 shown in FIG. 13 on the end cap and cup member 112 shown in FIGS. 11 and 13.

The cup member's 216 central plug portion 220 projects within cylinder 212 and defines pumping chamber 222 therein. The lower end of the cylinder 212 has a short transverse shoulder 223 that holds the plug portion 220 and cup 216 in the cylinder 212. The plug and cup 216 is constructed of a low durometer Shore A elastomeric material similar to that of end cap and cup 112 described with respect to the FIGS. 10 to 13 embodiment.

A through bore 225 extends centrally and transversally through plug portion 220 and intersects with an elliptical bore 226 extending centrally and axially part way through plug portion 220 that defines the main outlet passage from the pumping chamber 222. The bore 226 has minor diameter in plane perpendicular to the plane of FIG. 14 less than the diameter of the circular bore 225. Bore 225 is aligned with a slightly larger diameter bore 228 in cylinder 212 and together they receive a rotatable mode valve member 230 which serves the same function as the valve 114 above, i.e. to switch the pump assembly from the flexible bag evacuation mode to the rigid container evacuation mode. Bore 228 is a clearance bore that is larger than valve body 232, and bore 225 diameter is smaller than valve portion 232 to provide a leak-proof interference fit.

The valve member 230 has a cylindrical central portion 232, an enlarged head 233 at one end that limits axial motion of the valve member, and an enlarged head 235 at the other end with a circular recess 236 therein that forms the outlet port in the flexible bag evacuation mode shown in FIGS. 14 and 15. Port 236 receives a flexible probe assembly 240 identical to probe assembly 116 described in connection with FIGS. 10 and 11.

The inlet port 236 communicates through axial passage 242 in the valve member with a short radial passage 243 that communicates with the pumping chamber 222 through passage 226 in the flexible container evacuation mode shown in FIGS. 14 and 15.

A second passage 246 extends diametrally completely through valve member central portion 232 adjacent passage 243 but rotated 90 degrees with respect thereto. Valve passage 246 communicates the interior of the vacuum cup with the pump chamber 222 when the valve member 230 is in the rigid container evacuation mode illustrated in FIG. 17.

Enlarged valve member head 235 has a radial pointer 248 that indicates the mode the valve member is in. In the position illustrated in FIG. 14 the pumping chamber 222 is connected with the flexible container evacuating probe assembly 240. In that position diametral passage 246 is sealed by the elastomeric plug portion 220 because the minor diameter of the main outlet passage 226 in a plane perpendicular to the plane of FIG. 14 is less than the diameter of cross bore 225. This same relationship seals the short valve passage 243 when the valve member 230 is rotated 90 degrees to the rigid container evacuation position illustrated in FIG. 17.

Ball valve 260 is caged in enlarged portion 261 of the stepped bore 226 in plug portion 220 and cooperates with a valve seat 262 therein to form a check valve that prevents air flow into the probe assembly 240 as the piston assembly 213 moves downwardly to prevent the flexible container from inflating in the air discharge stroke in the same manner as the ball valve 136 and seat 138 in the FIGS. 10 to 13 embodiment described above. The stepped portion of bore 226 transitions from an elliptical to a round passage hole.

Figure 17:
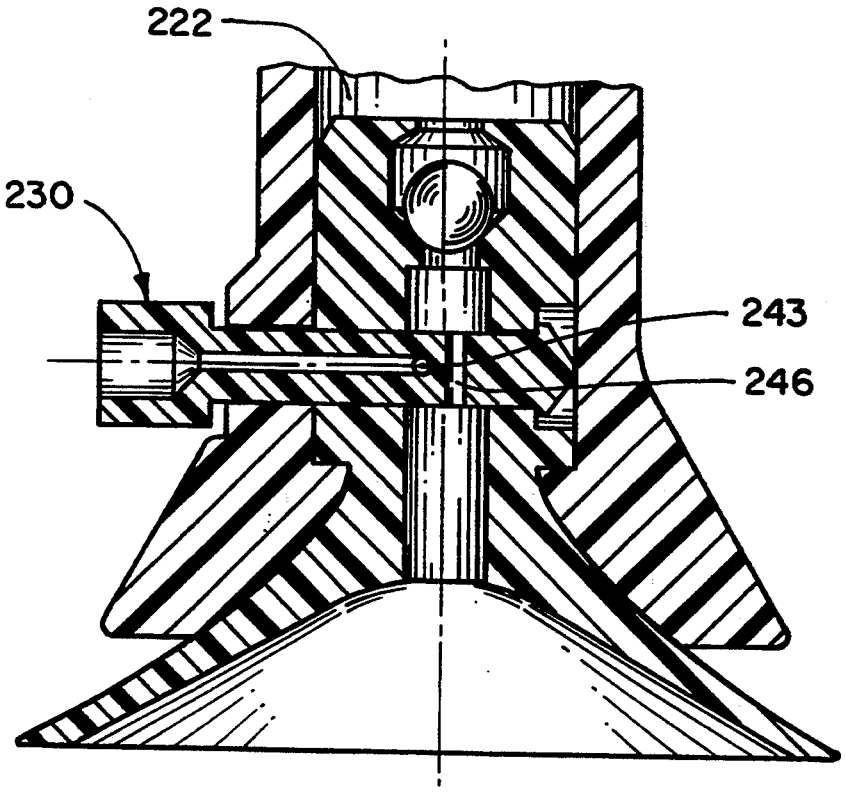
FIG. 17 is a fragmentary section similar to FIG. 14 showing the valve member rotated 90° from the position shown in FIG. 14 in its rigid container evacuation mode.

Thus it can be seen in the embodiment illustrated in FIGS. 14, 15 and 17, the valve 230 simply and easily changes modes for the pumping system 210 by merely rotating the valve 90 degrees.

I claim:

1. An evacuation system for both lidded rigid containers and sealable flexible containers, comprising: housing means, a reciprocating piston pump having a reciprocating piston in a pumping chamber in the housing means movable in a suction stroke and a discharge stroke, said pump including a check valve that closes during the suction stroke of the piston and opens during the return stroke, said pump having an actuator for the piston at one end and a sealable lid engaging vacuum cup at the other end, a first inlet port to the pumping chamber in the housing means communicating with the interior of the cup for evacuating rigid containers, a second inlet port to the pumping chamber in the housing means adapted to receive a flexible tube for evacuating flexible containers, and a valve member mounted in the pump movable to a first position connecting the first inlet port with the pumping chamber and blocking flow relative to the second inlet port and a second position communicating the second inlet port with the pumping chamber and blocking flow relative to the first inlet port, said valve member being slidably positioned in the housing means between said first and second positions thereof both within the housing means, said valve member covering the second inlet port in the first position, and covering the first inlet port in its second position, said valve member being non-removable from the housing means during normal operation of the evacuation system.

2. An evacuation system for both lidded rigid containers and sealable flexible containers as defined in claim 1, wherein the valve member is reciprocably mounted in the pump, said pump having a main inlet passage in which the valve member is movable, said valve member having a first radially extending valve passage communicating with the exterior of the valve member at one end and the axial passage in the valve member at a the other end, said valve member having a second radially extending valve passage co-planar with the first valve passage and extending completely through the valve member, said first and second valve passages being positioned so that in the first position of the valve member the first valve member is blocked and the second valve passage communicates the main inlet passage with the vacuum cup and in the second position of the valve member the second valve passage is blocked and the first valve passage communicates with the inlet passage.

3. An evacuation system for both lidded rigid containers and sealable flexible containers as defined in claim 1, wherein the valve member has an axis and is movably mounted in the end of the pump opposite the actuator adjacent the lid engaging vacuum cup, said second inlet port being formed in the valve member, and an axial passage in the valve member connecting the second inlet port to the flexible tube.

4. An evacuation system for both lidded rigid containers and sealable flexible containers as defined in claim 2, wherein the valve member is rotatably mounted in the pump.

5. An evacuation system for both lidded rigid containers and sealable flexible containers as defined in claim 3, wherein the valve member is reciprocably mounted in the pump.

6. An evacuation system for both lidded rigid containers and sealable flexible containers as defined in claim 3, wherein the valve member is rotatably mounted in the pump for 90 degree movement between the first and second positions, said valve member having a first radially directed valve passage communicating with the exterior of the valve member defining at the exterior the second inlet port and communicating with the axial passage in the valve member, and a second radially directed valve passage rotated 90 degrees from the first radially directed valve passage, communicating with the exterior of the valve member at two ends thereof.

7. An evacuation system for both lidded rigid containers and sealable flexible containers as defined in claim 6, said valve member is having an extended pointer indicating the position of the valve member.

8. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens on the return stroke, said pump having an actuator of the piston at one end and a sealable lid engaging vacuum cup at the other end, a first inlet port communicating with the interior of the cup, a second inlet port adapted to receive a flexible tube for evacuating flexible containers, a valve member having an axis mounted in the pump movable to a first position connecting the first inlet port with the pumping chamber and blocking flow relative to the second inlet port and a second position communicating the second inlet port with the pumping chamber and blocking flow relative to the first inlet port, the valve member being movable mounted in the end of the pump opposite the actuator adjacent the lid engaging cup, said second inlet port being formed in the valve member, and an axial passage in the valve connecting the second inlet port to the flexible tube, the valve member being rotatably mounted in the pump for 90 degree movement between the first and second positions, said valve member having a first radially directed valve passage communicating with the exterior of the valve member defining the second inlet port at the exterior and connected to the axial passage, and a second radially directed valve passage rotated 90 degrees from the first radially directed valve passage communicating with the exterior of the valve member at two ends thereof.

9. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens on the return stroke, said pump having an actuator for the piston at one end and a sealable lid engaging vacuum cup at the other end, a first inlet port communicating with the interior of the cup, a second inlet port adapted to receive a flexible tube for evacuating flexible containers, a valve member mounted in the pump movable to a first position connecting the first inlet port with the pumping chamber and blocking flow relative to the second inlet port and a second position communicating the second inlet port with the pumping chamber and blocking flow relative to the first inlet port, the valve member being movably mounted in the end of the pump opposite the actuator adjacent the lid engaging cup, said second inlet port being formed in an end of the valve member projecting from the pump, and an axial passage in the valve connecting the second inlet port to the pumping chamber, wherein the valve member is reciprocably mounted in the pump, said pump having a main inlet passage in which the valve member is movable, said valve member having a first radially extending valve passage communicating with the exterior of the valve member at one end and the axial passage in the valve member at the other end, said valve member having a second radially extending valve passage co-planar with the first valve passage and extending completely through the valve member, said first and second valve passages being positioned so that in the first position of the valve member the first valve passage is blocked and the second valve passage communicates the inlet passage with the cup and in the second position of the valve member the second valve passage is blocked and the first valve passage communicates with the inlet passage.

10. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens on the return stroke, said pump having an actuator for the piston at one end and a sealable lid engaging vacuum cup constructed of a relatively soft material at the other end, a first inlet port communicating with the interior of the cup, a second inlet port adapted to receive a flexible tube for evacuating flexible containers, a valve member mounted in the pump movable to a first position connecting the first inlet port with the pumping chamber and blocking flow relative to the second inlet port with the pumping chamber and blocking flow relative to the first inlet port, said cup being constructed of a flexible Shore A durometer material that has a central passage there-through that communicates with the pumping chamber and the interior of the cup, said cup having an upwardly extending projection extending in the pump, a cross bore extending through the projection intersecting the central passage, said valve member being removable mounted in the cross bore and having valve passages communicating with the valve member exterior, said passages being positioned to selectively communicate with the central passage or be blocked and sealed by the relatively soft cup material as the valve member moves from its first position to its second position.

* * * * *